US006694688B1

(12) United States Patent
Crepas

(10) Patent No.: US 6,694,688 B1
(45) Date of Patent: Feb. 24, 2004

(54) COVERING SYSTEM FOR SURFACES

(76) Inventor: Robert A Crepas, 15W725 Virginia La., Elmhurst, IL (US) 60126

( * ) Notice: Subject to any disclaimer, the term of this patent is extended or adjusted under 35 U.S.C. 154(b) by 0 days.

(21) Appl. No.: 10/094,723

(22) Filed: Mar. 11, 2002

(51) Int. Cl.[7] ..... E04F 13/08
(52) U.S. Cl. ..... 52/391; 52/586.1; 404/41
(58) Field of Search ..... 52/391, 586.1, 52/586.2; 404/41; 446/93

(56) References Cited

U.S. PATENT DOCUMENTS 1,787,480 A * 1/1931 Jaspert ..... 404/40
1,840,974 A * 1/1932 Rockwell ..... 144/350
1,968,714 A * 7/1934 Schuck ..... 52/391
2,049,571 A * 8/1936 Schuck ..... 52/586.1
3,614,915 A * 10/1971 Perry ..... 404/40
4,095,388 A * 6/1978 Breault ..... 52/747.11
4,497,858 A * 2/1985 Dupont et al. ..... 428/44
4,571,353 A * 2/1986 Gable, Jr. ..... 428/33
4,850,739 A * 7/1989 Gargollo ..... 404/41
5,133,620 A * 7/1992 Scheiwiller ..... 404/37
5,182,891 A * 2/1993 Slocum ..... 52/480
6,450,853 B1 * 9/2002 Larws ..... 446/93
6,484,467 B2 * 11/2002 Crout ..... 52/483.1

* cited by examiner

*Primary Examiner*—Carl D. Friedman
*Assistant Examiner*—Nahid Amiri
(74) *Attorney, Agent, or Firm*—Michael I Kroll

(57) ABSTRACT

A covering system for walls, floors, ceilings, and other surfaces, having covering units joined by locking keys. Additional components adapt the system to corners and a variety of surface edges.

16 Claims, 17 Drawing Sheets

COVERING SYSTEM FOR SURFACES

BACKGROUND OF THE INVENTION

1 Field of the Invention

The present invention relates generally to tongue and groove style floor, wall and ceiling covering methods and, more specifically, to a covering system for cooperating units such as bricks, tiles, blocks or any other suitable application that may benefit from incorporating the combined elements of the present invention.

2 Description of the Prior Art

There are other interlocking covering systems known in the art. While these systems may be suitable for the purposes for which they were designed, they would not be as suitable for the purposes of the present invention, as hereinafter described.

SUMMARY OF THE PRESENT INVENTION

A primary object of the present invention is to provide a covering system for floor, wall and ceiling coverings that locks the individual units to one another and seals the gaps therebetween.

Another object of the present invention is to provide a covering system for floor, wall and ceiling coverings wherein the covering material may be covering units of bricks, tiles, blocks or other like covering material, each covering unit having a continuous groove extending around the periphery thereof.

Yet another object of the present invention is to provide a covering system for floor, wall and ceiling coverings having a complement of locking keys ("L-keys") that are of an appropriate thickness to slide into the groove of the covering unit and a width approximately twice the depth of said groove to form the connection between the adjacent covering units.

Still yet another object of the present invention is to provide a covering system for floor, wall and ceiling coverings wherein the locking keys are coated with a sealing agent prior to placement within the covering units thereby forming a mechanical bond that hermetically seals the joint thereby negating the need for grout.

Yet another object of the present invention is to provide a covering system for floor, wall and ceiling coverings that is inexpensive to manufacture and operate.

One more object of the present invention is to provide a covering system for floor, wall and ceiling coverings that is simple and easy to use.

Additional objects of the present invention will appear as the description proceeds.

The covering units have a groove extending peripherally along the outer edges. Locking keys that conform substantially to the shape of the covering units and the thickness of the unit's grooves are provided that are coated with a sealing agent and inserted into the grooves during installation to form a watertight seal thereby negating the need to grout to seal the mating areas where the adjacent interlocking members abut. An entire complement of components is included to allow the user to secure and seal the tile at wall edges, inside corners, outside corners, perpendicular tile joints and other such specialized situations that may arise. The present invention is faster and easier to install than other conventional floor, wall and ceiling coverings and may be put into service immediately upon completion as no curing time is required and grouting is unnecessary.

A surface covering system is provided, comprising: a plurality of substantially rectangular covering units, each covering unit having a top surface, a bottom surface, and four sides, the four sides comprising a first pair of opposing sides and a second pair of opposing sides, each of the four sides having a groove; and a plurality of L-keys, the L-keys having a first portion and a second portion joined to the first portion to form a substantially 90 degree angle, the first portion having an inner edge, and an outer edge, the second portion having an inner edge and an outer edge, the first portion length being substantially equal to the length of the covering unit first pair of sides, the second portion length being substantially equal to the length of the covering unit second pair of sides, the L-key first portion width being approximately twice the width of the covering unit grooves, the L-key second portion width being approximately twice the width of the covering unit groove, the L-key first and second portion inner and outer edges being insertable in the covering unit grooves.

There is provided a surface covering system, comprising: a plurality of substantially rectangular covering units, each covering unit having a top surface, a bottom surface, and four sides, the four sides comprising a first pair of opposing sides and a second pair of opposing sides, each of the four sides having a groove; a plurality of L-keys, the L-keys having a first portion and a second portion joined to the first portion to form a substantially 90 degree angle, the first portion having an inner edge, and an outer edge, the second portion having an inner edge and an outer edge, the first portion length being substantially equal to the length of the covering unit first pair of sides, the second portion length being substantially equal to the length of the covering unit second pair of sides, the L-key first portion width being approximately twice the width of the covering unit grooves, the L-key second portion width being approximately twice the width of the covering unit groove, the L-key first and second portion inner and outer edges being insertable in the covering unit grooves; a plurality of elongated I-strips, the I-strips having a first and second edge the first and second edges being insertable in the covering unit grooves, the I-strips having a width approximately twice the width of the covering unit grooves; a plurality of elongated half strips, the half strips having a first and second edge, the first and second edges being insertable in the covering unit grooves, the half strips having a width approximately equal to the width of the covering unit grooves; a side strip, the side strip having a vertical portion joined with a horizontal portion, the vertical portion having an edge and the horizontal portion having an edge, said edges being insertable into the covering unit grooves; an inside comer strip wherein the side strip is angled to form a corner, the horizontal portion edge being within the corner; an outside corner strip wherein the side strip is angled to form a corner, the horizontal portion edge 84 being outside the corner; a spacer side strip, the spacer side strip having a vertical portion joined with a horizontal portion and a spacer portion, the spacer portion being proximate the exterior vertex of the angle formed by the joinder of the vertical portion to the horizontal portion, the vertical portion having an edge and the horizontal portion having an edge, said edges being insertable into the covering unit grooves, the spacer portion having a bottom surface and a rear surface, the spacer portion extending beneath the horizontal portion such that when the horizontal portion edge is inserted within the groove of one of the covering units, the covering unit bottom surface is substantially flush with the spacer portion bottom surface, the spacer portion extending rearwardly from the vertical portion such that when the vertical portion edge is inserted into a second one of the covering units, the second covering unit's bottom surface is substantially flush with the spacer portion rear surface, and the second covering unit's side of insertion abuts the top surface of the first covering unit; a spacer inside corner strip wherein the spacer side strip is angled to form a corner, the horizontal portion edge being within the corner; a spacer outside corner strip wherein the spacer side strip is angled to form a corner, the horizontal portion edge being outside the corner; a double spacer side strip, the double spacer side strip having a vertical portion joined with a horizontal portion, a first spacer portion, and a second spacer portion, the first spacer portion being proximate the exterior vertex of the angle formed by the joinder of the vertical portion to the horizontal portion, the second spacer portion being proximate the interior vertex of said angle, the vertical portion having an edge and the horizontal portion having an edge, said edges being insertable into the covering unit grooves, the first spacer portion having a bottom surface and a rear surface, the second spacer portion having a top surface and a forward surface, the first spacer portion extending beneath the horizontal portion such that when the horizontal portion edge is inserted within the groove of one of the covering units, the covering unit bottom surface is substantially flush with the first spacer portion bottom surface and the covering unit top surface is substantially flush with the second spacer portion top surface, the first spacer portion extending rearwardly from the vertical portion such that when the vertical portion edge is inserted into a second one of the covering units, the second covering unit's bottom surface is substantially flush with the first spacer portion rear surface and the second covering unit's top surface is substantially flush with the second spacer portion forward surface; a double spacer inside corner strip wherein the side strip is angled to form a corner, the horizontal portion edge being within the corner; and a double spacer outside corner strip wherein the side strip is angled to form a corner, the horizontal portion edge being outside the corner.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWING FIGURES

In order that the invention may be more fully understood, it will now be described, by way of example, with reference to the accompanying drawing in which:

FIG. 1 is an illustrative view of the present invention in use a floor is being laid using interlocking covering units of the present invention.

FIG. 2 is a perspective view of various components of the present invention. Various possible components of the interlocking and seal joint system are shown. The primary components are the covering unit, the locking key, and the side strip. Inside and outside corner strips are also included as well as many variations of the locking keys and the side strips. I-strips are used on covering units ending on a wall. Half-strips are used to fill the grooves on the covering units set against walls without side strips.

FIG. 3 is a perspective view of the various basic geometric units of the present invention. One covering unit and a locking key joined as one piece form the basic geometric pattern that can be repeated across an area to be covered. When inserted into place, the ends of a locking key come flush with the inside surfaces of the groove in the covering unit.

FIG. 4 is a perspective assembly view of the covering units of the present invention. Three basic geometric units are shown assembled, in which the locking keys continue to fill the grooves of the covering units as they are assembled. The exposed locking keys around the assembled units act as tongues, to which additional units with grooves can be fitted.

FIG. 5 is a cross sectional side view of the present invention taken from FIG. 4 as indicated. The sectional view shows how the covering units are fitted to the locking keys. Grooves matching the locking keys are set around the edges of the covering units admitting half of the width of the locking keys. The covering units and the locking keys are secured to one another with sealant while the covering units are adhesively secured on a casting bed on the floor.

FIG. 6 is a top view of an exemplary installation using the covering units, locking keys, I-strips, half strips, inside corner strips and side strips to finish a rectangular area with no exposed grooves.

FIG. 7 is an exploded perspective view of a corner assembly. An inside corner strip is used for this assembly. The locking key is shown out of the groove of the covering unit on the floor.

FIG. 8 is a perspective view of various components and method of assembly of the present invention. For a staggered layout, half units can be used to start a particular row of covering units. Side strips can be used to continue up the walls.

Figure 11:
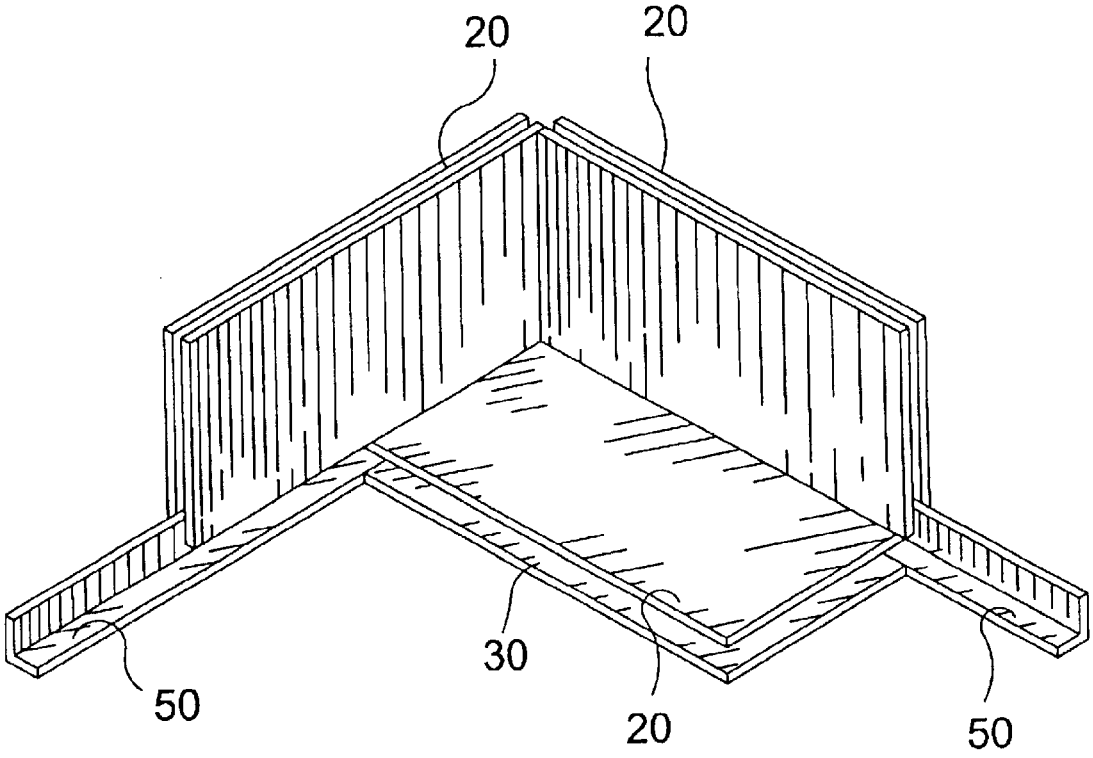

FIG. 11 is a perspective view of a corner assembly. One way of joining units at a corner is shown. A special corner strip can be used to join the covering units at a corner.

Figure 12:
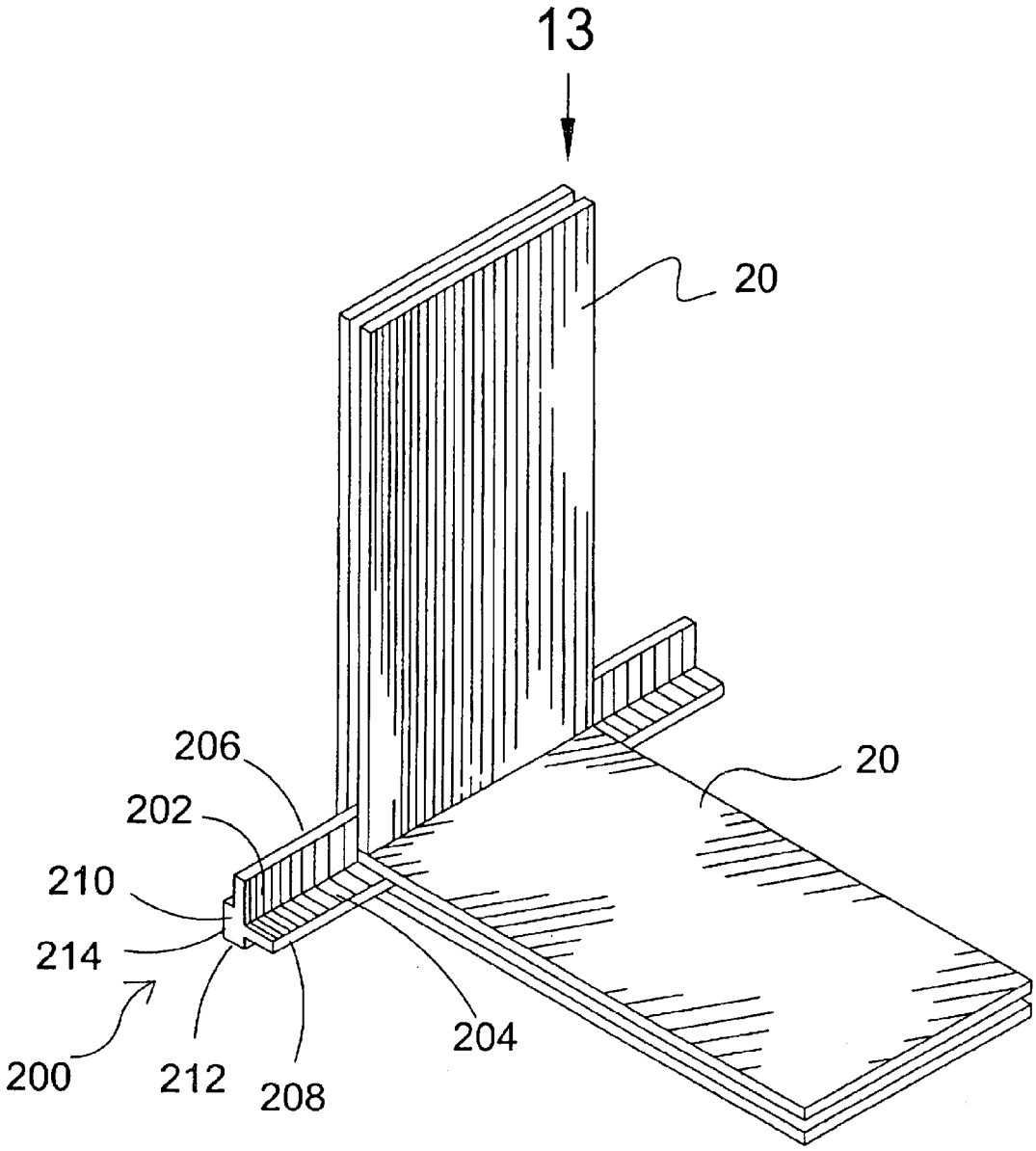

FIG. 12 is a perspective view of an alternative side strip in use. One version of a modified side strip is shown in the assembly. The side strip fills the edge where a wall and a floor join to provide for a stronger joint.

Figure 13:
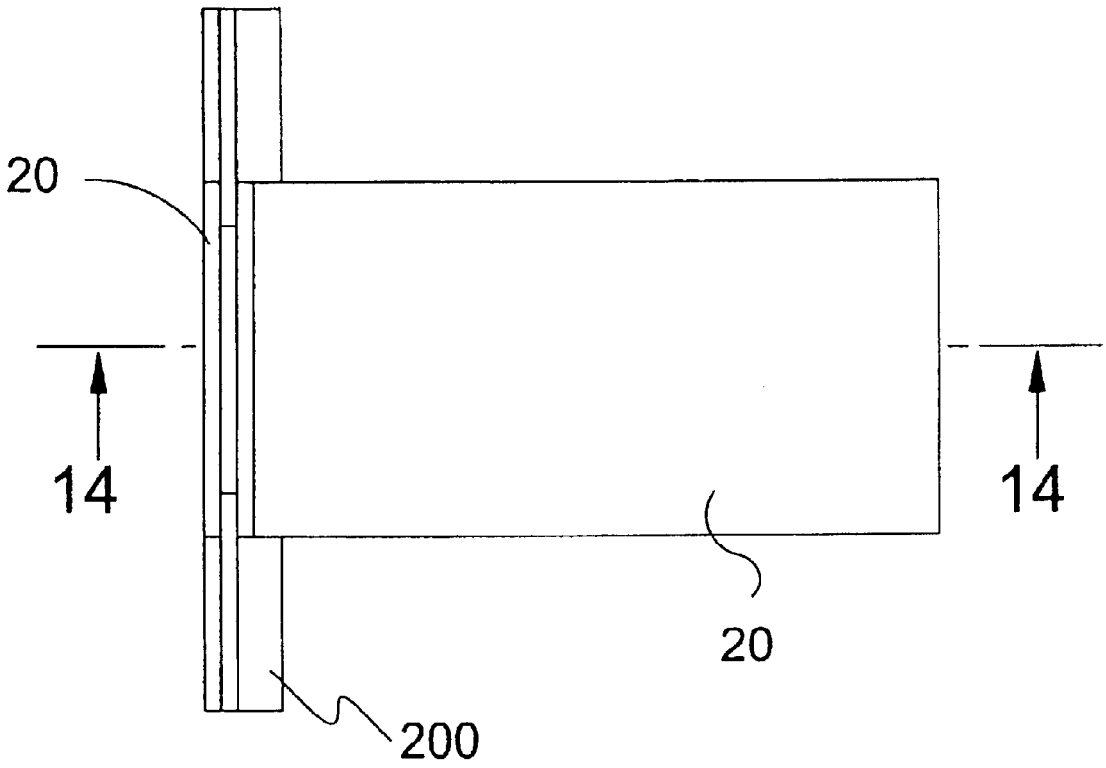

FIG. 13 is a top view of the assembly taken from FIG. 12 as indicated.

Figure 10:
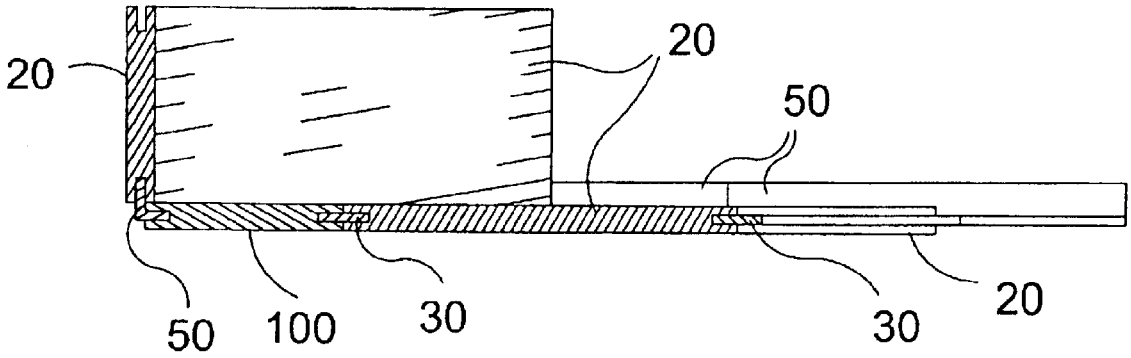
FIG. 10 is a cross sectional side view of the assembled covering units taken from FIG. 8 as indicated. This cross-sectional view shows a side strip fitted to join two units at 90°.
Figure 14:
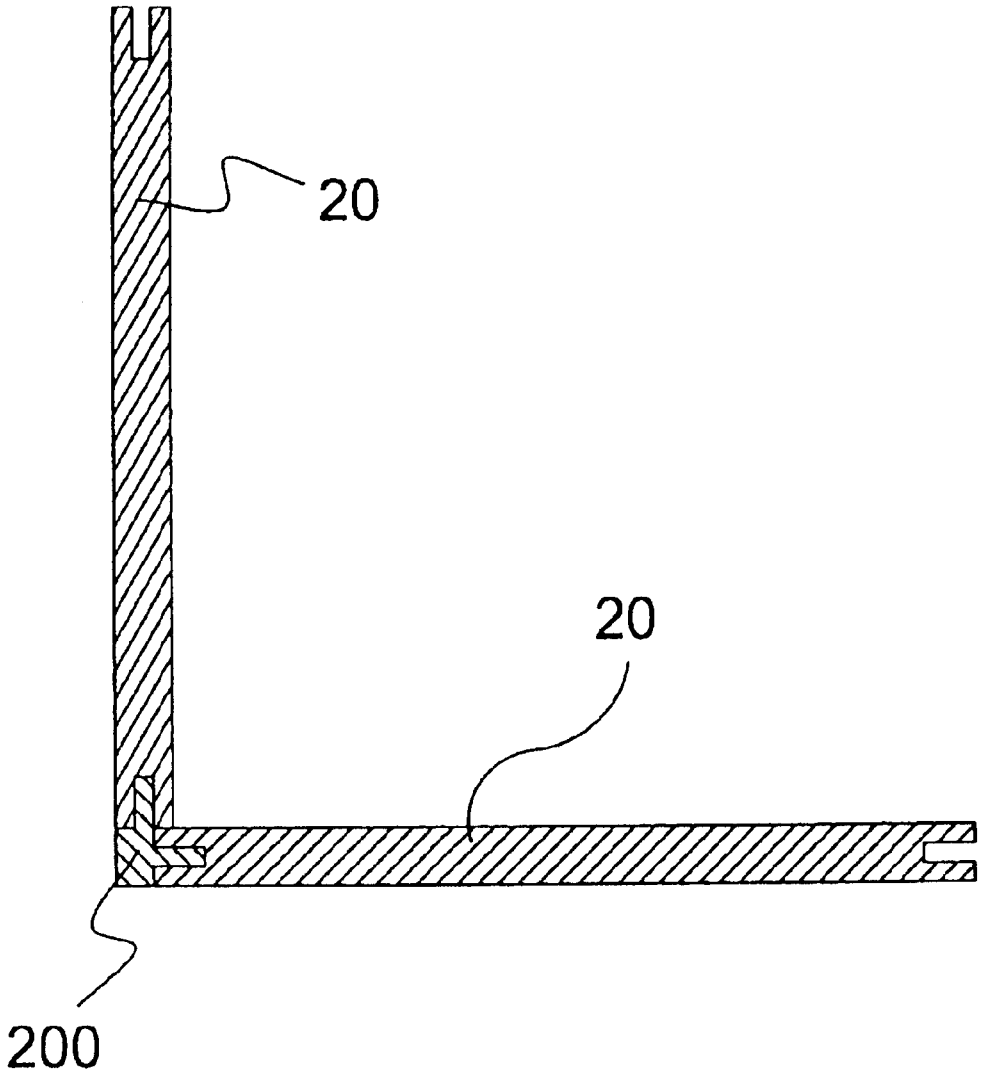

FIG. 14 is a cross sectional side view of the assembly taken from FIG. 13 as indicated. The side strip shown in the sectional view of FIG. 10 creates a void. The alternative side strip shown above fills this space. This results in a stronger joint.

Figure 15:
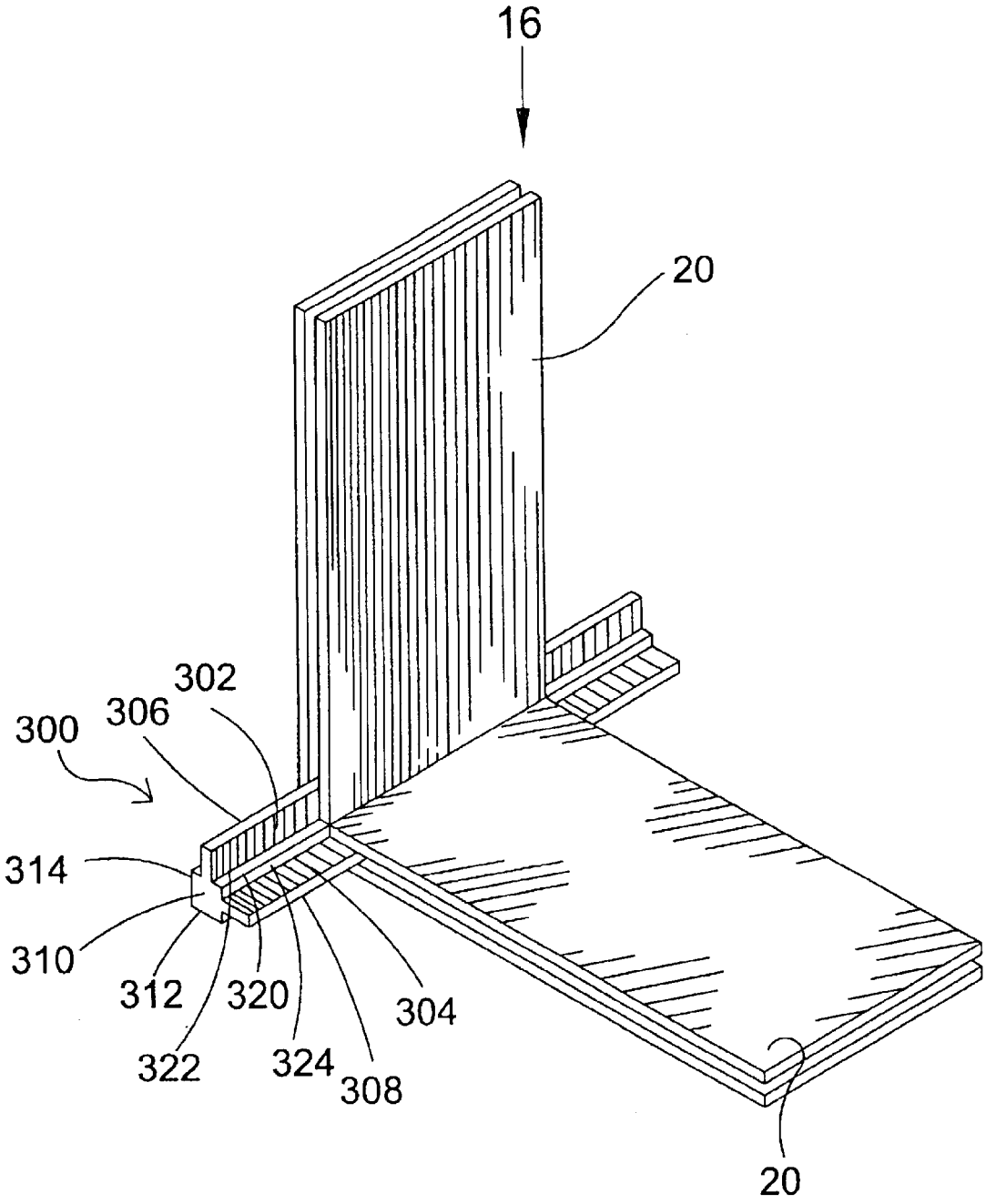

FIG. 15 is a perspective view of another alternative side strip in use. Shown is a variation of the side strip that also fills the void around the side edges. In this case, the two covering units do not overlap each other.

Figure 16:
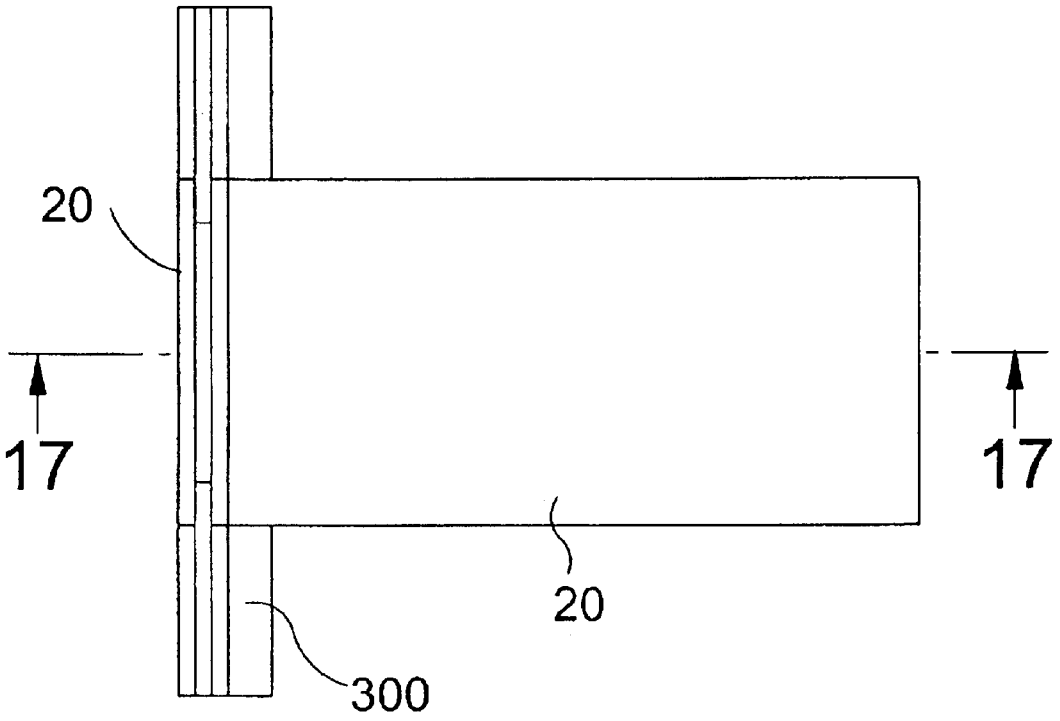

FIG. 16 is a top view of the assembly taken from FIG. 15 as indicated. The side strip also solidly joins the two covering units together. Differing from the previous side strips, the two covering units do not overlap one another.

Figure 17:
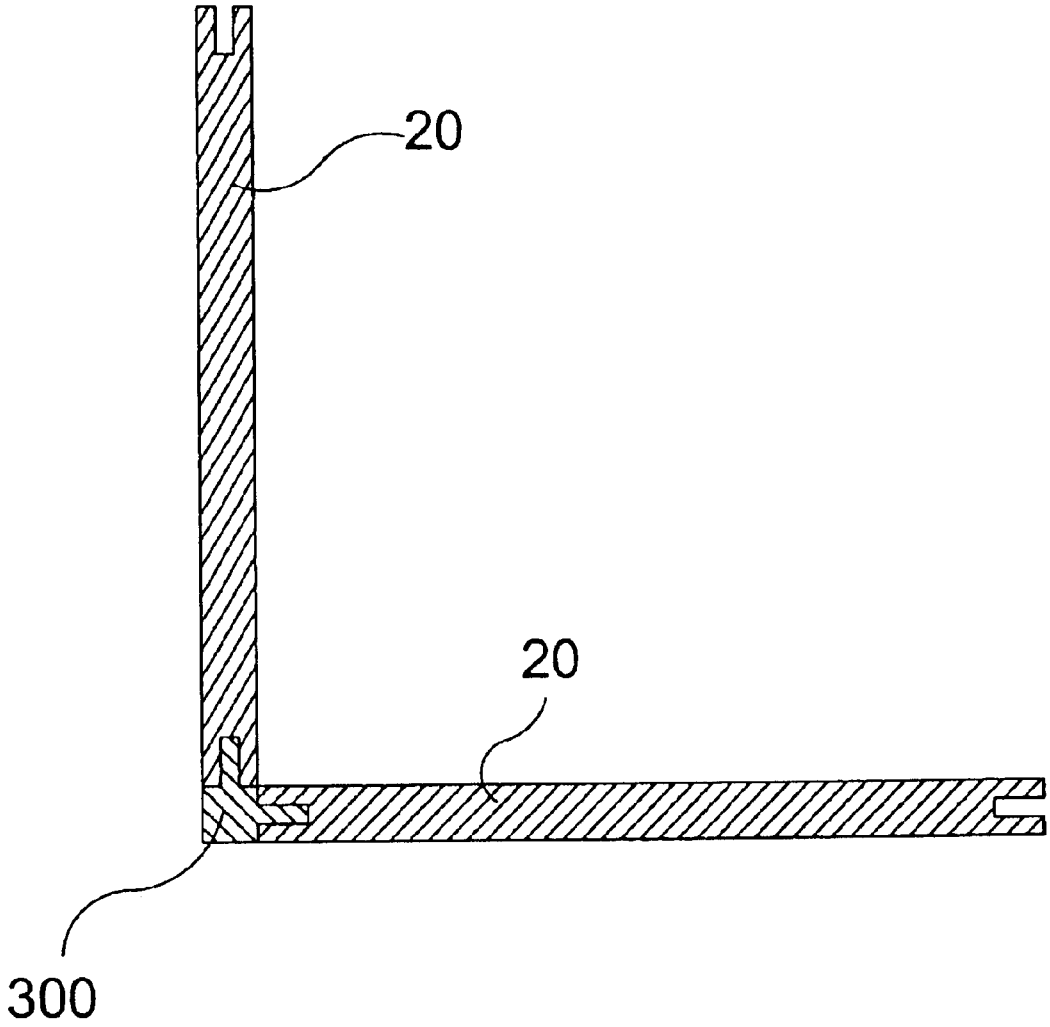

FIG. 17 is across sectional side view of the assembly taken from FIG. 16 as indicated.

DESCRIPTION OF 1THE REFERENCED NUMERALS

Turning now descriptively to the drawings, in which similar reference characters denote similar elements throughout the several views, the figures illustrate the present invention. With regard to the reference numerals used, the following numbering is used throughout the various drawing figures.

10 Surface Covering System of the present invention
12 floor
14 wall
16 casting bed
20 covering unit
22 covering unit top surface
23 covering unit bottom surface
24 covering unit side
25 covering unit side
26 covering unit side
27 covering unit side
28 covering unit groove
30 locking key (L-key)
32 locking key first portion
34 locking key second portion
36 locking key first portion end
37 locking key first portion inner edge
38 locking key first portion outer edge
40 locking key second portion end
41 locking key second portion inner edge
42 locking key second portion outer edge
43 I-strip
44 I-strip first edge
45 I-strip second edge
46 half strip
47 half strip first edge
48 half strip second edge
50 side strip
52 side strip vertical portion
54 side strip horizontal portion
56 side strip vertical portion edge
58 side strip horizontal portion edge
70 inside corner strip
72 inside corner strip corner
74 inside corner strip horizontal edge
76 inside corner strip vertical edge
80 outside corner strip
82 outside corner strip corner
84 outside corner strip horizontal edge
86 outside corner strip vertical edge
90 alternate side strip
100 square covering unit
200 spacer side strip
202 spacer side strip vertical portion
204 spacer side strip horizontal portion
206 spacer side strip vertical portion edge
208 spacer side strip horizontal portion edge
210 spacer side strip spacer portion
212 spacer side strip spacer portion bottom surface
214 spacer side strip spacer portion rear surface
250 alternate inside corner strip
252 alternate inside corner strip corner
254 alternate inside corner strip horizontal portion edge
256 alternate inside corner strip vertical portion edge
300 double spacer side strip
302 double spacer side strip vertical portion
304 double spacer side strip horizontal portion
306 double spacer side strip vertical portion edge
308 double spacer side strip horizontal portion edge
310 double spacer side strip first spacer portion
312 double spacer side strip first spacer portion bottom surface
314 double spacer side strip first spacer portion rear surface
320 double spacer side strip second spacer portion
322 double spacer side strip second spacer portion top surface
324 double spacer side strip second spacer portion forward surface
350 alternate inside corner strip
352 alternate inside corner strip corner
354 alternate inside corner strip horizontal portion edge
356 alternate inside corner strip vertical portion edge

DESCRIPTION OF EXEMPLARY EMBODIMENTS OF THE INVENTION

The following discussion describes in detail exemplary embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
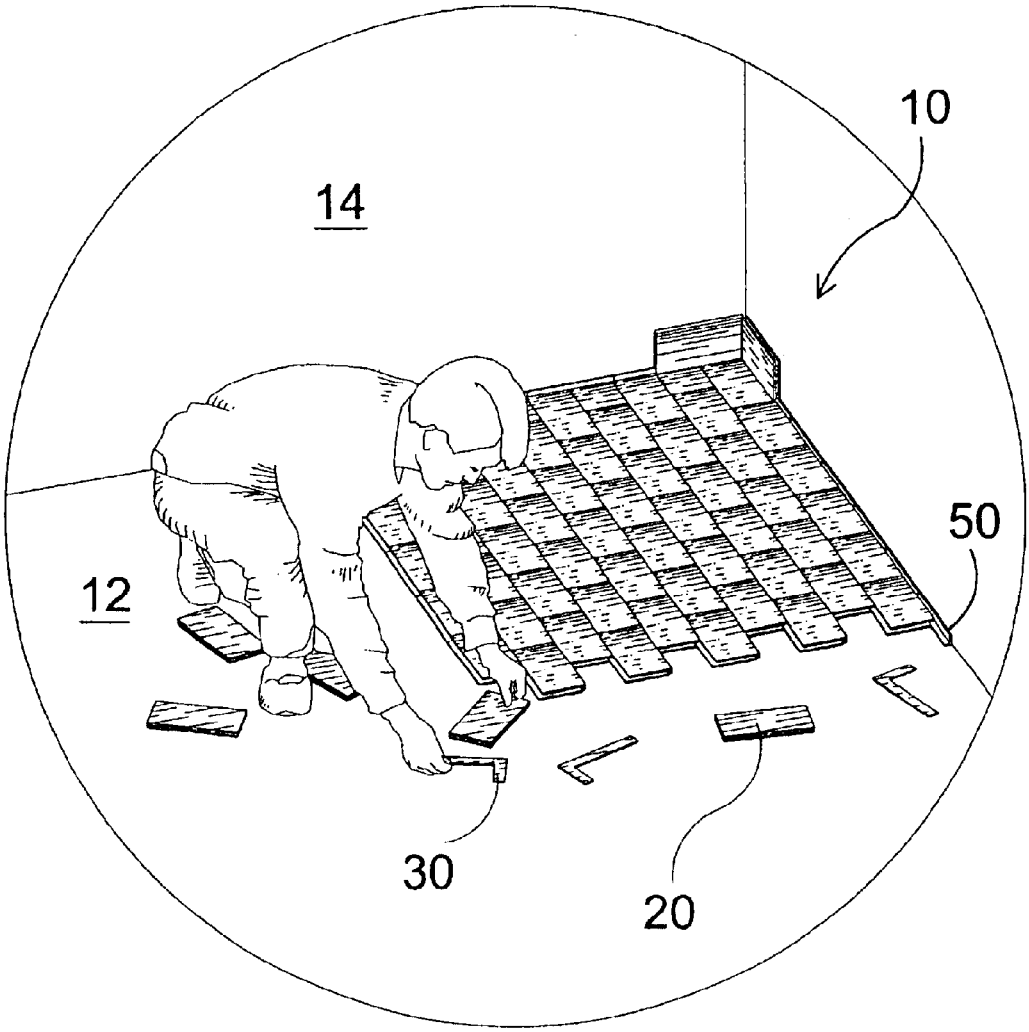

As shown in FIG. 1 a surface covering system 10 is used for covering surfaces such as floors 12, walls 14, and ceilings. To properly cover these surfaces the system must be configurable to fit in corners and in the junction between wall and floor, and wall and ceiling.

Figure 2:
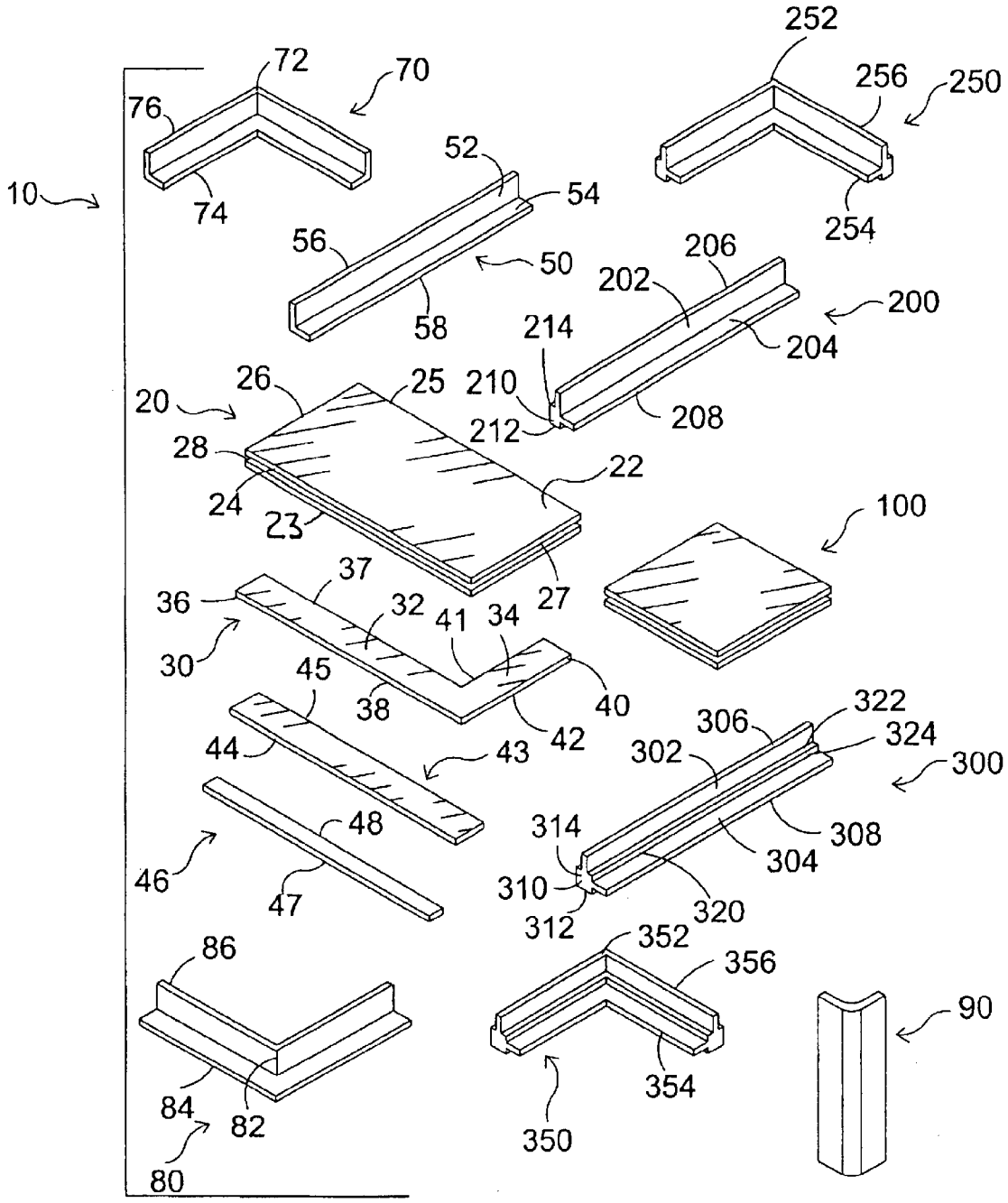

Turning now to FIG. 2, an exemplary embodiment of the system is shown to comprise a plurality of substantially rectangular covering units, each covering unit having a top surface 22, a bottom surface 23, and four sides 24,25,26,27, the four sides comprising a first pair of opposing sides 24,25, and a second pair of opposing sides 26,27, each of the four sides having a groove 28. This embodiment further comprises a plurality of L-keys 30, the L-keys having a first portion 32 and a second portion 34 joined to the first portion to form a substantially 90 degree angle, the first portion having an end 36, an inner edge 37, and an outer edge 38, the second portion having an end 40, an inner edge 41 and an outer edge 42. The first portion length is substantially equal to the length of the covering unit first pair of sides and the second portion length is substantially equal to the length of the covering unit second pair of sides.

Figure 3:
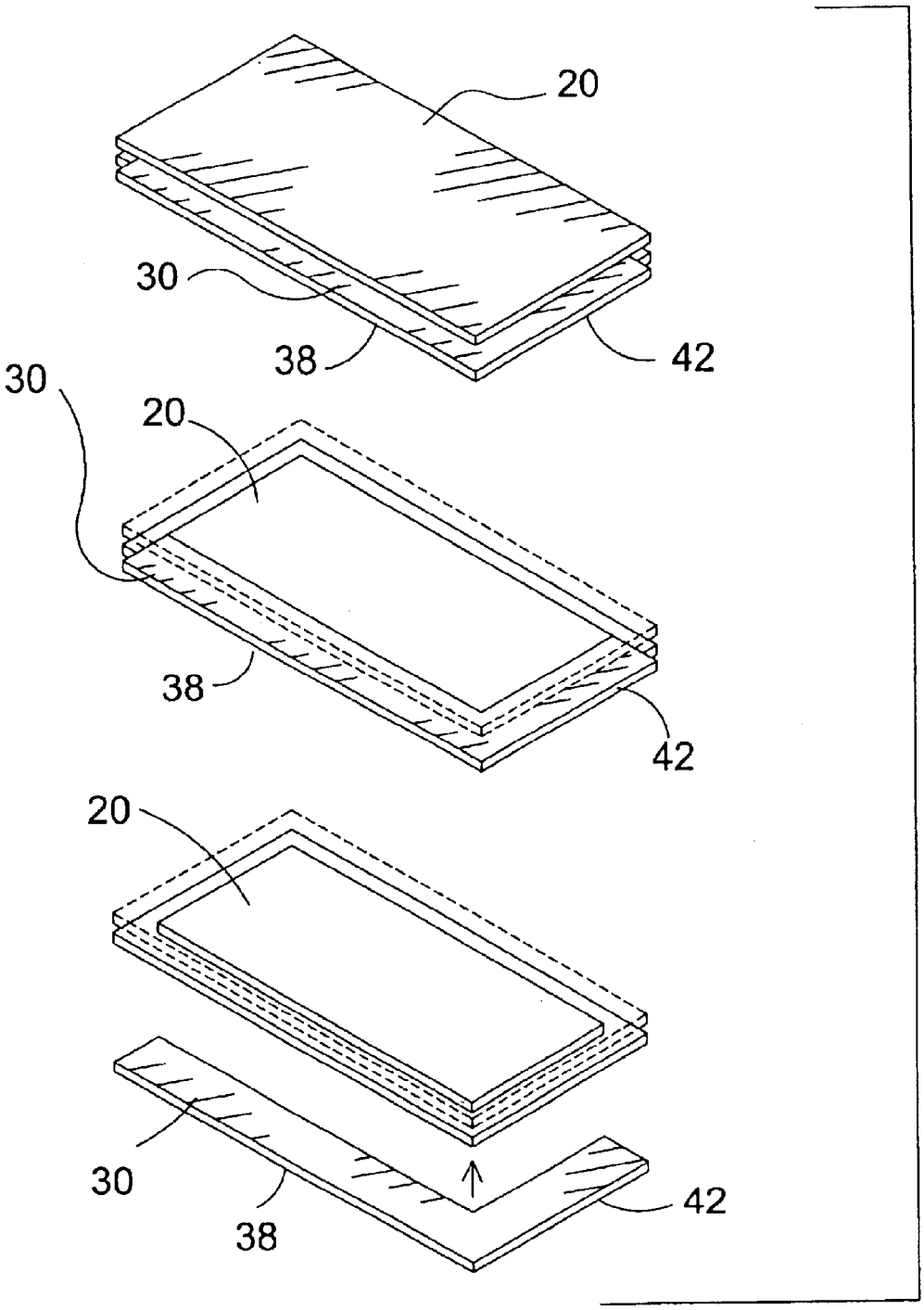
Figure 4:
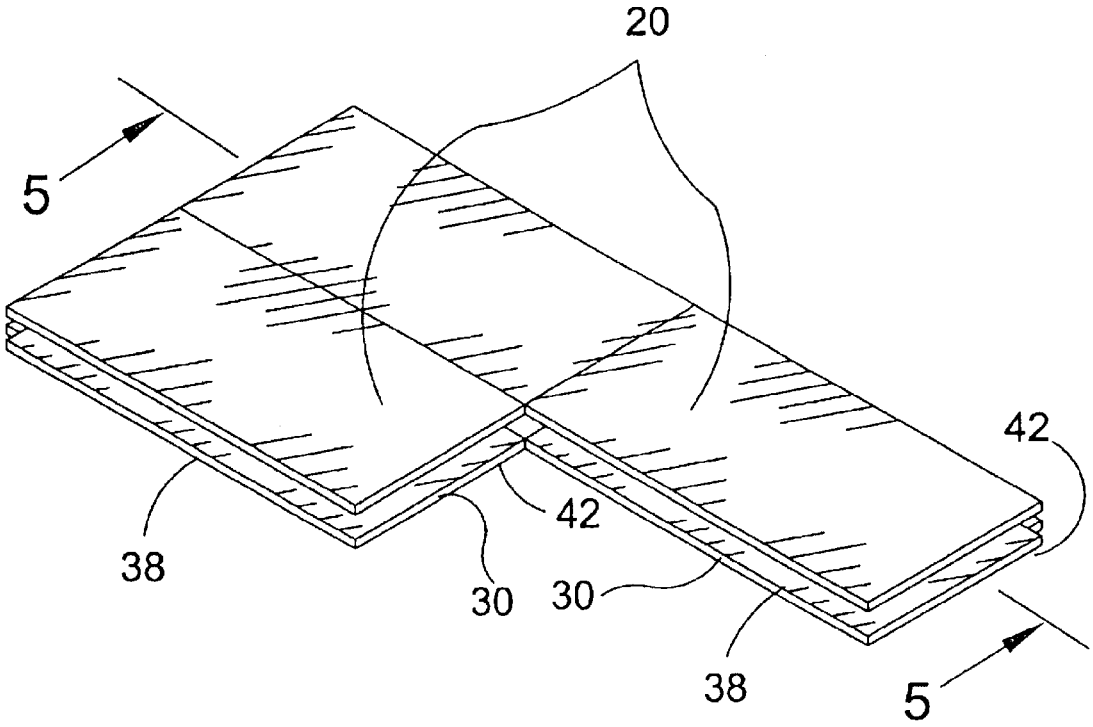
Figure 5:
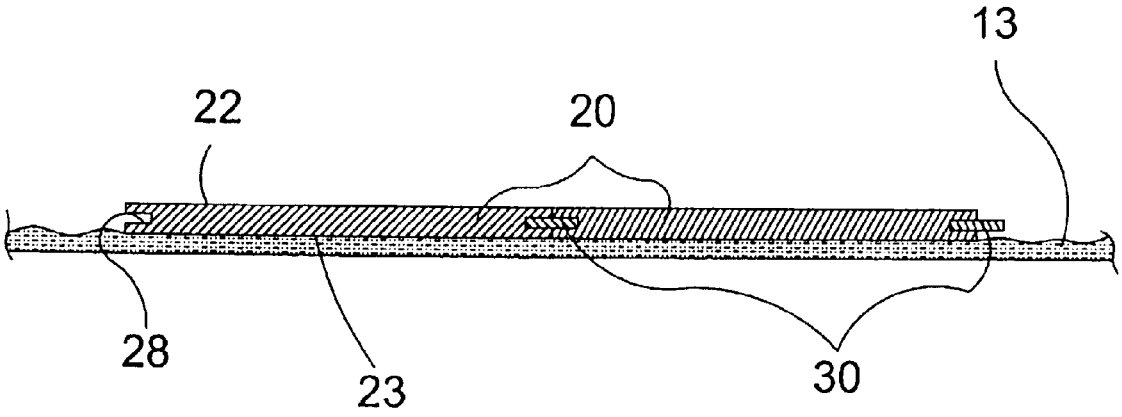

In this exemplary embodiment, the L-key first portion width is approximately twice the width of the covering unit grooves and the L-key second portion width is approximately twice the width of the covering unit groove. The L-key first and second portion inner and outer edges are sized to be insertable in the covering unit grooves. As shown in FIGS. 3–5, the L-key is inserted into two side grooves on a covering unit, leaving the L-key outer edges protruding. When the protruding outer edges are inserted into additional covering units, the covering units are interlocked. Additional L-keys, similarly inserted into the additional covering unit grooves, position additional L-key protruding edges for further attachment of yet additional covering units.

The attachment of the covering units 20 results in flush top surfaces 22 and flush bottom surfaces 23 on the covering units. As shown in FIG. 5, the bottom surfaces nestle conveniently on the casting bed 13 which permanently adheres the covering units to the floor 12.

In this exemplary embodiment, the covering unit top surface 22 and bottom surface 23 are substantially planar. In some embodiments, the top and/or bottom surfaces are non-planar.

Figure 6:
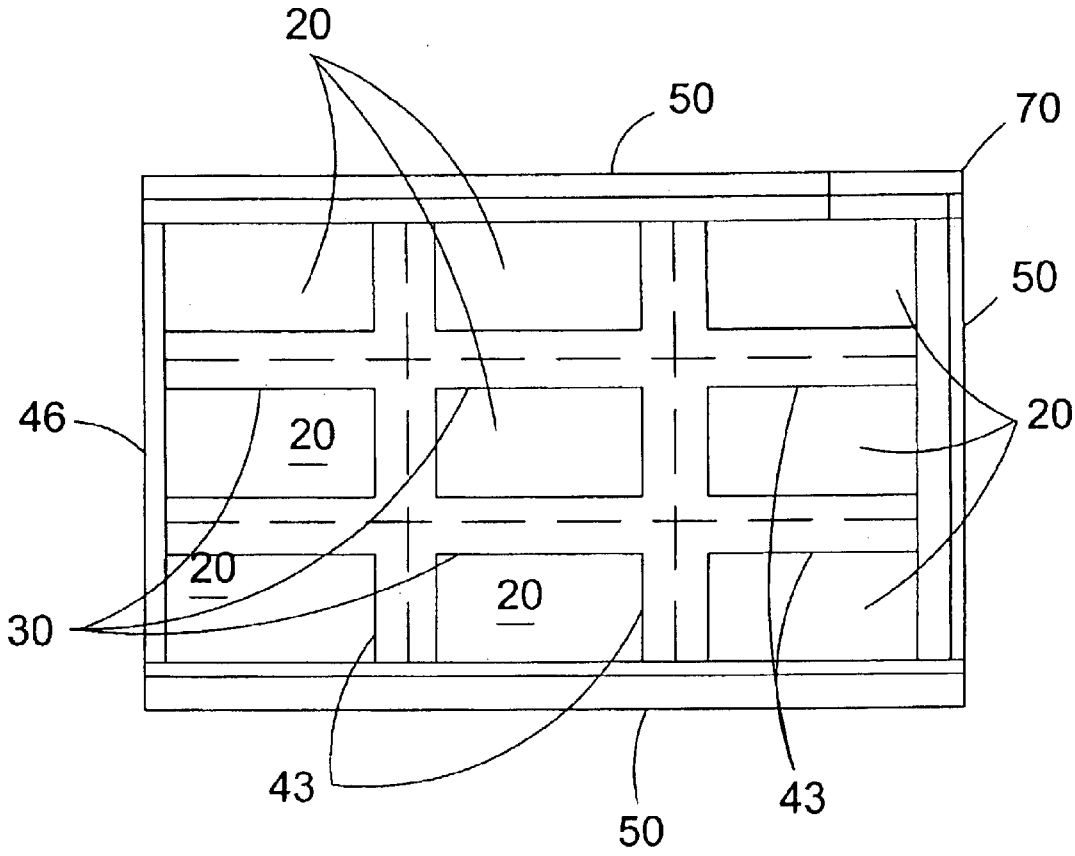
Figure 7:
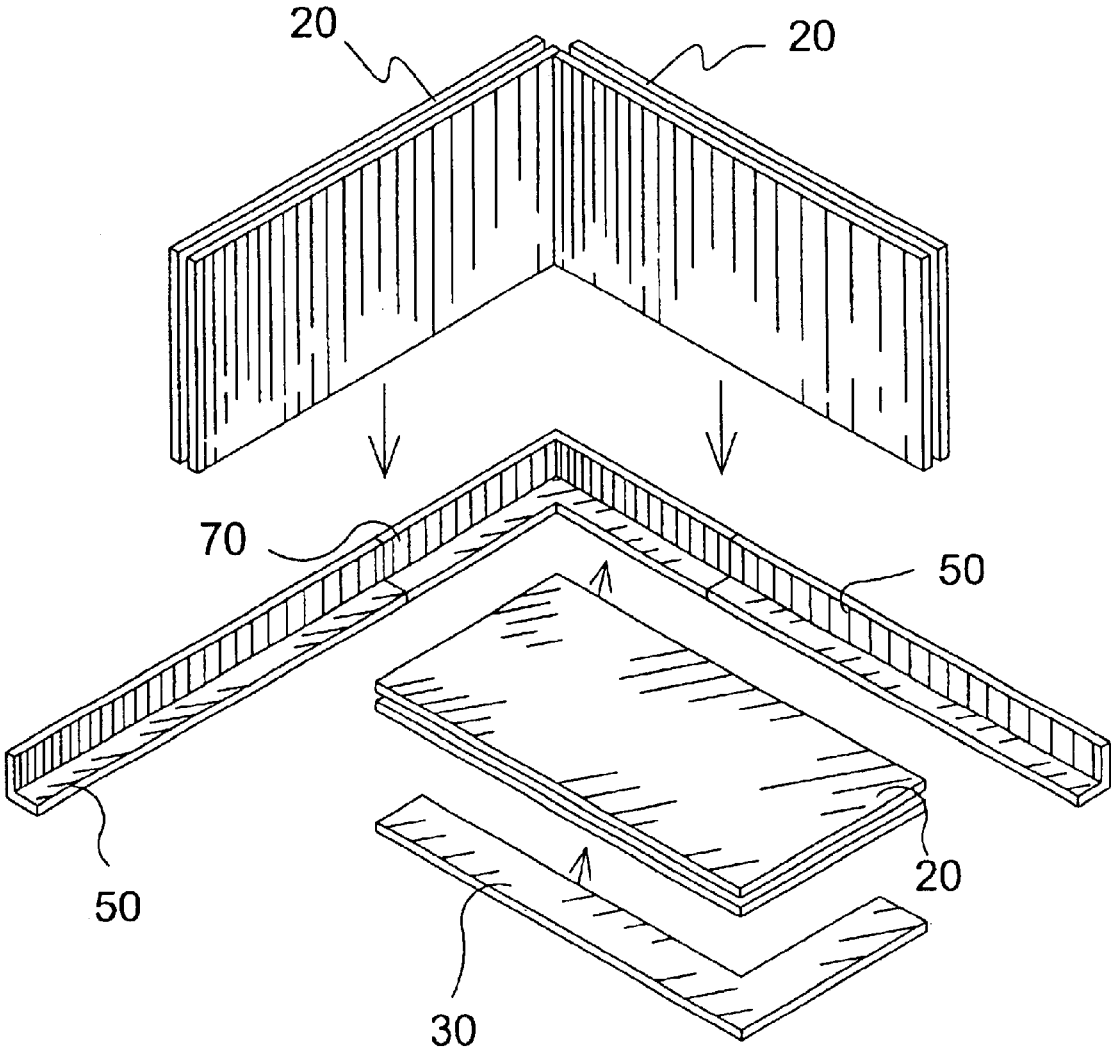

The covering units 20 are trimmable to conform to the areal surface of the floor 12 or wall 14. However, in some embodiments, of the type shown in FIG. 6, other system components are available to assist in conforming the components to the areal surface being covered. In these embodiments, the system further comprises a plurality of elongated I-strips 43, the I-strips having a first 44 and second edge 45, the first and second edges being insertable in the covering unit grooves. These I-strips have a width approximately twice the width of the covering unit grooves.

Additionally, embodiments of the system comprise a plurality of elongated half strips 46, the half strips having a first edge 47 and second edge 48, the first and second edges being insertable in the covering unit grooves. These half strips have a width approximately equal to the width of the covering unit grooves.

For completing an areal surface edge, such as an exposed edge or along the junction of a wall and floor, embodiments of the system comprise a side strip 50, side strip having a vertical portion 52 joined with a horizontal potion 54. The vertical portion has an edge 56 and the horizontal portion has an edge 58, the edges being insertable into the covering unit grooves.

Similarly, these embodiments include an inside corner strip 70 wherein the strip is angled to form a corner 72, the horizontal portion edge 74 being within the corner. The vertical edge 76 is also angled.

Turning again to FIG. 6, the interlocking capabilities of the covering units L-keys, I-strips, half-strips, side strips and inside corner strips are illustrated. Nine equally sized covering units 20 are interlocked using four L-keys keys 30, two I-keys 43, one half-strip 46, one inside corner strip 70, and three side strips 50, of varying lengths. One of the side strips 50 is turned to abut the covering unit sides and has its horizontal portion flush with the floor.

Turning now to FIGS. 7–11, the interlocking capabilities of the covering units, L-keys, I-strips, half-strips, side strips and inside corner strips are again illustrated. A covering unit is placed such that the corner strip horizontal portion edges are inserted within the closest covering strip grooves. In exemplary installations, such as the installation in FIGS. 7–11, the typical installation of the side strip 50 and the inside corner strip 70 will result in the horizontal portion being spaced from the floor. This is shown particularly in FIG. 10.

Figure 8:
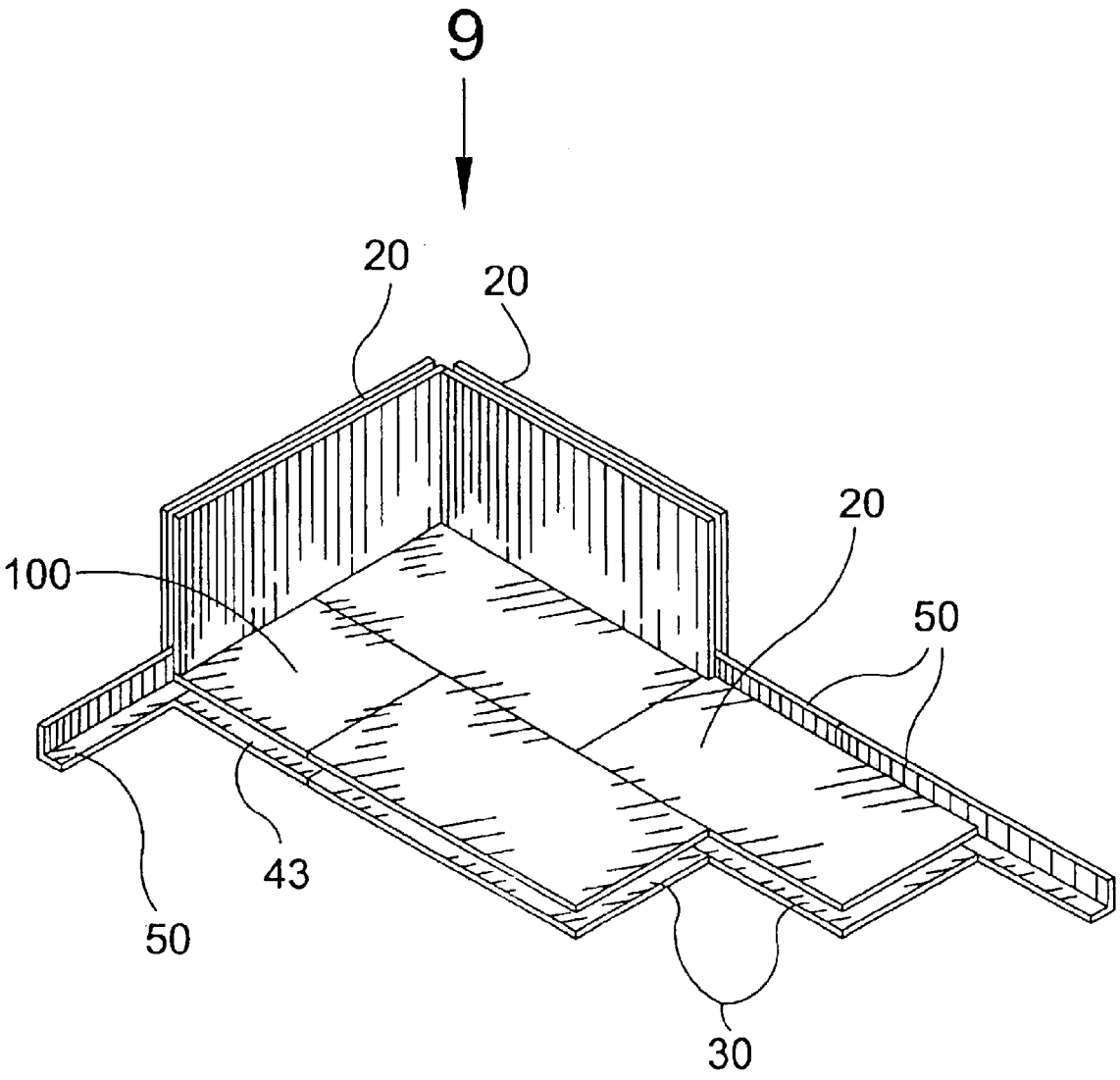
Figure 9:
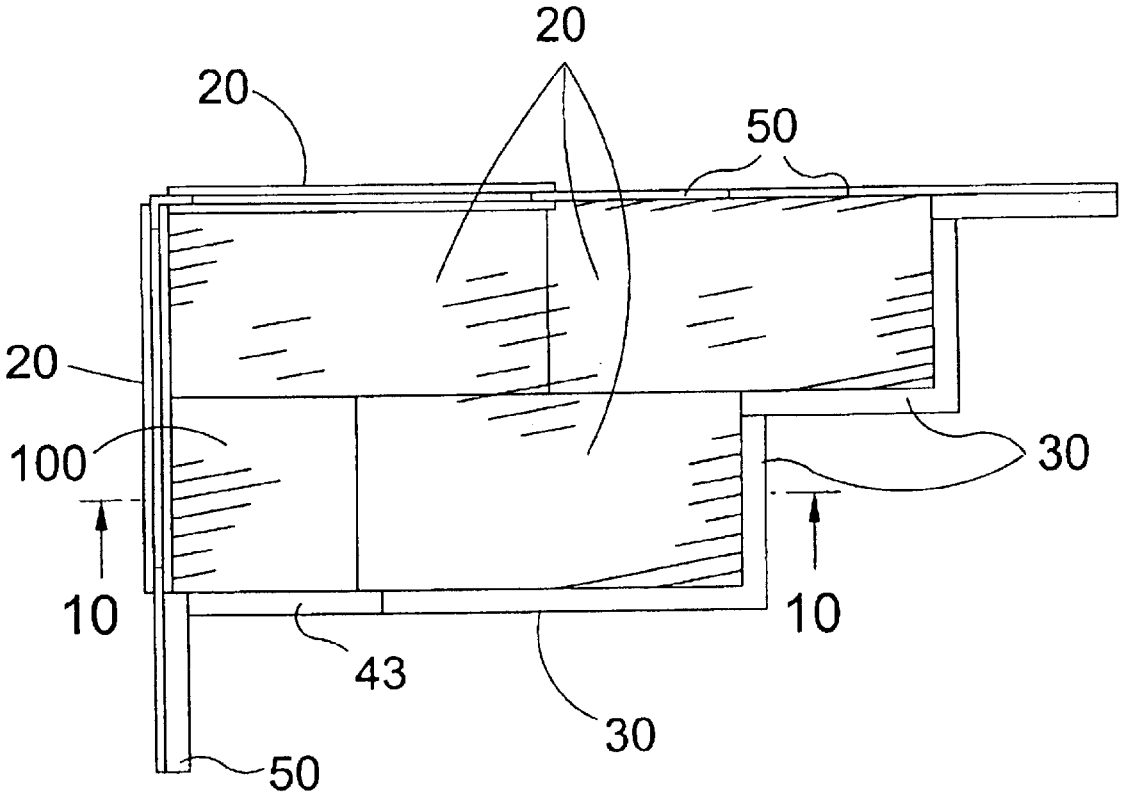
FIG. 9 is a top view of the assembled covering units taken from FIG. 8 as indicated. This view shows a side strip fitted to join two covering units at 90°.

Turning again to FIG. 7, the exemplary embodiment is shown to allow covering units to be attached to the vertical portions of the inside corner strip and the side strips, thus beginning the areal coverage of the wall surface. As shown in FIG. 8, the joinder of the covering units between wall and floor is a flush presentation with a well defined right angle.

As further shown in FIG. 8, the system includes a covering unit 100 wherein the first, second, third, and fourth sides are equal in length.

In some embodiments, an outside corner strip 80 is provided, wherein the side strip, as shown in FIG. 1, is angled to form a corner 82, the horizontal portion edge 84 being outside the corner. The vertical portion edge 86 is also angled. A typical installation involves a surface area that encompasses a corner structure such that the surface area is outside the corner. For such an installation, some embodiments of the system include the outside corner strip 80.

In some embodiments, a side strip component 90, as shown in FIG. 1, is provided wherein the joinder of the vertical portion and the horizontal portion are rounded.

Turning now to FIGS. 12–14, an exemplary embodiment is illustrated wherein the system further comprises a spacer side strip 200, the side strip having a vertical portion 202 joined with a horizontal portion 204 and a spacer portion 210, the spacer portion being proximate the exterior vertex of the angle formed by the joinder of the vertical portion to the horizontal portion. The vertical portion has an edge 206 and the horizontal portion has an edge 208, the edges being insertable into the covering unit grooves.

The spacer side strip spacer portion has a bottom surface 212 and a rear surface 214 and the spacer portion extends beneath the horizontal portion such that when the horizontal portion edge is inserted within the groove of one of the covering units, the covering unit bottom surface is substantially flush with the spacer portion bottom surface.

The spacer strip spacer portion also extends rearwardly from the vertical portion such that when the vertical portion edge is inserted into a second one of the covering units, the second covering unit's bottom surface is substantially flush with the spacer portion rear surface. In this configuration the second covering unit's side of insertion abuts the top surface of the first covering unit. This flush configuration is particularly illustrated in FIG. 14.

In such embodiments, the system provides an inside corner strip 250, as shown in FIG. 1, wherein the spacer side strip is angled to form a corner 252, the horizontal portion edge 254 being within the corner. The vertical edge 256 is also angled.

In some embodiments, the system provides an outside corner strip wherein the spacer side strip is angled to form a corner, the horizontal portion edge being outside the corner.

In some embodiments of the type in FIGS. 15–17, the system comprises a double spacer side strip 300 having a vertical portion 302 joined with a horizontal portion 304, a first spacer portion 310, and a second spacer portion 320, the first spacer portion being proximate the exterior vertex of the angle formed by the joinder of the vertical portion to the horizontal portion, the second spacer portion being proximate the interior vertex of said angle. The vertical portion has an edge 306 and the horizontal portion has an edge 308, the edges being insertable into the covering unit grooves.

The double spacer side strip first spacer portion has a bottom surface 312 and a rear surface 314 and the second spacer portion has a top surface 322 and a forward surface 324. The first spacer portion extends beneath the horizontal portion such that when the horizontal portion edge is inserted within the groove of one of the covering units, the covering unit bottom surface is substantially flush with the first spacer portion bottom surface and the covering unit top surface is substantially flush with the second spacer portion top surface.

The first spacer portion also extends rearwardly from the vertical portion such that when the vertical portion edge is inserted into a second one of the covering units, the second covering unit's bottom surface is substantially flush with the first spacer portion rear surface and the second covering unit's top surface is substantially flush with the second spacer portion forward surface. This flush configuration is particularly illustrated in FIG. 17.

In such embodiments, and as shown in FIG. 1, the system provides an inside corner strip 350 wherein the double spacer side strip is angled to form a corner 352, the horizontal portion edge 354 being within the corner. The vertical edge 356 is also angled.

In some embodiments, the system provides an outside corner strip wherein the double spacer side strip is angled to form a corner, the horizontal portion edge being outside the corner.

With respect to the above description then, it is to be realized that the optimum material and dimensional relationships for the parts of the system will include variations in size, materials, shape, and form, which will occur to those skilled in the art upon review of the present disclosure. For example, the components are constructed, in various embodiments, from wood, plastic, metal, brick, tile, ceramics, blocks and the like. In various embodiments, adhesives fix the various edges within the grooves upon insertion.

All equivalent relationships to those illustrated in the drawings and described in the specification are intended to be encompassed by the present invention

What is claimed as new and desired to be protected by Letters Patent is set forth in the appended claims:

1. A surface covering system, comprising:

a plurality of substantially rectangular covering units, each covering unit having a top surface, a bottom surface, and four sides, the four sides comprising a first pair of opposing sides and a second pair of opposing sides, each of the four sides having a groove; and a plurality of L-keys, the L-keys having a first portion and a second portion joined to the first portion to form a substantially 90 degree angle, the first portion having an inner edge, and an outer edge, the second portion having an inner edge and an outer edge, the first portion length being substantially equal to the length of the covering unit first pair of sides, the second portion length being substantially equal to the length of the covering unit second pair of sides, the L-key first portion width being approximately twice the width of the covering unit grooves, the L-key second portion width being approximately twice the width of the covering unit groove, the L-key first and second portion inner and outer edges being insertable in the covering unit grooves.

2. The system of claim 1, wherein the system further comprises a plurality of elongated I-strips, the I-strips having a first and second edge, the first and second edges being insertable in the covering unit grooves, the I-strips having a width approximately twice the width of the covering unit grooves.

3. The system of claim 1, wherein the system further comprises a plurality of elongated half strips, the half strips having a first and second edge, the first and second edges being insertable in the covering unit grooves, the half strips having a width approximately equal to the width of the covering unit grooves.

4. The system of claim 1, wherein the system further comprises a side strip, the side strip having a vertical portion joined with a horizontal portion, the vertical portion having an edge and the horizontal portion having an edge, said edges being insertable into the covering unit grooves.

5. The system of claim 4, wherein the side strip is angled to form a corner, the horizontal portion edge being within the corner.

6. The system of claim 4, wherein the side strip is angled to form a corner, the horizontal portion edge being outside the corner.

7. The system of claim 4, wherein the joinder of the vertical portion and the horizontal portion are rounded.

8. The system of claim 1, wherein the covering unit first, second, third, and fourth sides are substantially equal in length.

9. The system of claim 1, wherein the system further comprises a spacer side strip, the side strip having a vertical portion joined with a horizontal portion 204 and a spacer portion, the spacer portion being proximate the exterior vertex of the angle formed by the joinder of the vertical portion to the horizontal portion, the vertical portion having an edge and the horizontal portion having an edge, said edges being insertable into the covering unit grooves, the spacer portion having a bottom surface and a rear surface, the spacer portion extending beneath the horizontal portion such that when the horizontal portion edge is inserted within the groove of one of the covering units, the covering unit bottom surface is substantially flush with the spacer portion bottom surface, the spacer portion extending rearwardly from the vertical portion such that when the vertical portion edge is inserted into a second one of the covering units, the second covering unit's bottom surface is substantially flush with the spacer portion rear surface, and the second covering unit's side of insertion abuts the top surface of the first covering unit.

10. The system of claim 9, wherein the spacer side strip is angled to form a corner, the horizontal portion edge being within the corner.

11. The system of claim 9, wherein the spacer side strip is angled to form a corner, the horizontal portion edge being outside the corner.

12. The system of claim 1, wherein the system further comprises a double spacer side strip, the side strip having a vertical portion joined with a horizontal portion, a first spacer portion, and a second spacer portion, the first spacer portion being proximate the exterior vertex of the angle formed by the joinder of the vertical portion to the horizontal portion, the second spacer portion being proximate the interior vertex of said angle, the vertical portion having an edge and the horizontal portion having an edge, said edges being insertable into the covering unit grooves, the first spacer portion having a bottom surface and a rear surface, the second spacer portion having a top surface and a forward surface, the first spacer portion extending beneath the horizontal portion such that when the horizontal portion edge is inserted within the groove of one of the covering units, the covering unit bottom surface is substantially flush with the first spacer portion bottom surface and the covering unit top surface is substantially flush with the second spacer portion top surface, the first spacer portion extending rearwardly from the vertical portion such that when the vertical portion edge is inserted into a second one of the covering units, the second covering unit's bottom surface is substantially flush with the first spacer portion rear surface and the second covering unit's top surface is substantially flush with the second spacer portion forward surface.

13. The system of claim 12, wherein the double spacer side strip is angled to form a corner, the horizontal portion edge being within the corner.

14. The system of claim 12, wherein the double spacer side strip is angled to form a corner, the horizontal portion edge being outside the corner.

15. A surface covering system, comprising:

a plurality of substantially rectangular covering units, each covering unit having a top surface, a bottom surface, and four sides, the four sides comprising a first pair of opposing sides and a second pair of opposing sides, each of the four sides having a groove;

a plurality of L-keys, the L-keys having a first portion and a second portion joined to the first portion to form a substantially 90 degree angle, the first portion having an inner edge, and an outer edge, the second portion having an inner edge and an outer edge, the first portion length being substantially equal to the length of the covering unit first pair of sides, the second portion length being substantially equal to the length of the covering unit second pair of sides, the L-key first portion width being approximately twice the width of the covering unit grooves, the L-key second portion width being approximately twice the width of the covering unit groove, the L-key first and second portion inner and outer edges being insertable in the covering unit grooves;

a plurality of elongated I-strips, the I-strips having a first and second edge, the first and second edges being insertable in the covering unit grooves, the I-strips having a width approximately twice the width of the covering unit grooves;

a plurality of elongated half strips, the half strips having a first and second edge, the first and second edges being insertable in the covering unit grooves, the half strips having a width approximately equal to the width of the covering unit grooves;

a side strip, the side strip having a vertical portion joined with a horizontal portion, the vertical portion having an edge and the horizontal portion having an edge, said edges being insertable into the covering unit grooves;

an inside corner strip wherein the side strip is angled to form a corner, the horizontal portion edge being within the corner; and an outside corner strip wherein the side strip is angled to form a corner, the horizontal portion edge being outside the corner.

16. A surface covering system, comprising:

a plurality of substantially rectangular covering units, each covering unit having a top surface, a bottom surface, and four sides, the four sides comprising a first pair of opposing sides and a second pair of opposing sides, each of the four sides having a groove;

a plurality of L-keys, the L-keys having a first portion and a second portion joined to the first portion to form a substantially 90 degree angle, the first portion having an inner edge, and an outer edge, the second portion having an inner edge and an outer edge, the first portion length being substantially equal to the length of the covering unit first pair of sides, the second portion length being substantially equal to the length of the covering unit second pair of sides, the L-key first portion width being approximately twice the width of the covering unit grooves, the L-key second portion width being approximately twice the width of the covering unit groove, the L-key first and second portion inner and outer edges being insertable in the covering unit grooves;

a plurality of elongated I-strips, the I-strips having a first and second edge the first and second edges being insertable in the covering unit grooves, the I-strips having a width approximately twice the width of the covering unit grooves;

a plurality of elongated half strips, the half strips having a first and second edge, the first and second edges being insertable in the covering unit grooves, the half strips having a width approximately equal to the width of the covering unit grooves;

a side strip, the side strip having a vertical portion joined with a horizontal portion, the vertical portion having an edge and the horizontal portion having an edge, said edges being insertable into the covering unit grooves;

an inside corner strip wherein the side strip is angled to form a corner, the horizontal portion edge being within the corner;

an outside corner strip wherein the side strip is angled to form a corner, the horizontal portion edge 84 being outside the corner;

a spacer side strip, the spacer side strip having a vertical portion joined with a horizontal portion and a spacer portion, the spacer portion being proximate the exterior vertex of the angle formed by the joinder of the vertical portion to the horizontal portion, the vertical portion having an edge and the horizontal portion having an edge, said edges being insertable into the covering unit grooves, the spacer portion having a bottom surface and a rear surface, the spacer portion extending beneath the horizontal portion such that when the horizontal portion edge is inserted within the groove of one of the covering units, the covering unit bottom surface is substantially flush with the spacer portion bottom surface, the spacer portion extending rearwardly from the vertical portion such that when the vertical portion edge is inserted into a second one of the covering units, the second covering unit's bottom surface is substantially flush with the spacer portion rear surface, and the second covering unit's side of insertion abuts the top surface of the first covering unit;

a spacer inside corner strip wherein the spacer side strip is angled to form a corner, the horizontal portion edge being within the corner; a spacer outside corner strip wherein the spacer side strip is angled to form a corner, the horizontal portion edge being outside the corner;

a double spacer side strip, the double spacer side strip having a vertical portion joined with a horizontal portion, a first spacer portion, and a second spacer portion, the first spacer portion being proximate the exterior vertex of the angle formed by the joinder of the vertical portion to the horizontal portion, the second spacer portion being proximate the interior vertex of said angle, the vertical portion having an edge and the horizontal portion having an edge, said edges being insertable into the covering unit grooves, the first spacer portion having a bottom surface and a rear surface, the second spacer portion having a top surface and a forward surface, the first spacer portion extending beneath the horizontal portion such that when the horizontal portion edge is inserted within the groove of one of the covering units, the covering unit bottom surface is substantially flush with the first spacer portion bottom surface and the covering unit top surface is substantially flush with the second spacer portion top surface, the first spacer portion extending rearwardly from the vertical portion such that when the vertical portion edge is inserted into a second one of the covering units, the second covering unit's bottom surface is substantially flush with the first spacer portion rear surface and the second covering unit's top surface is substantially flush with the second spacer portion forward surface;

a double spacer inside corner strip wherein the side strip is angled to form a corner, the horizontal portion edge being within the corner; and a double spacer outside corner strip wherein the side strip is angled to form a corner, the horizontal portion edge being outside the corner.

* * * * *